US005601448A

United States Patent [19]

Poon

[11] Patent Number: 5,601,448

[45] Date of Patent: Feb. 11, 1997

[54] CONNECTOR FOR LIGHTING SYSTEM AND METHOD

[75] Inventor: Kar K. Poon, Kowloon, Hong Kong

[73] Assignee: Sunskill Industries, Ltd., Kowloon, Hong Kong

[21] Appl. No.: 408,546

[22] Filed: Mar. 21, 1995

[51] Int. Cl.[6] ..... H01R 4/24

[52] U.S. Cl. ..... 439/419; 439/417

[58] Field of Search ..... 439/611, 417, 439/418, 419, 404, 409, 411, 412, 413, 426

[56] References Cited

U.S. PATENT DOCUMENTS 2,657,367 10/1953 Brooks ..... 439/414
2,742,549 4/1956 Peters ..... 439/412
3,148,009 9/1964 Abramson ..... 439/414
4,648,675 3/1987 Gaines ..... 439/411

*Primary Examiner*—David L. Pirlot
*Attorney, Agent, or Firm*—Kennedy & Kennedy

[57] ABSTRACT

A connector for electrical communication between a low-voltage lamp and an electrical cable connected with a source of low-voltage electricity. The connector has a base with two opposed sections that define a channel for receiving the cable. Distal ends of each section have threaded radially outward surfaces for receiving a threaded cap. A presser in the cap pushes the cable into piercing engagement with a pair of nails in the channel for providing electrical communication between the cable and a lamp having a pair of wires connected to the nails. A U-shaped positioner is received within the channel over the electrical cable therein for accommodating narrow gauge cable. A method of connecting a lamp to an electrical cable is disclosed.

6 Claims, 1 Drawing Sheet

CONNECTOR FOR LIGHTING SYSTEM AND METHOD

TECHNICAL FIELD

The present invention relates generally to low-voltage lighting systems. More particularly, the present invention relates, to connectors and methods for electrical communication between low-voltage lamps and electrical cables connected with sources of low-voltage electricity in lighting systems.

BACKGROUND OF THE INVENTION

Outdoor lighting provides a number of practical and aesthetic benefits for buildings and homes and for garden areas including lawns, walkways, and pool facilities. Among the practical benefits are safety for walking and security, by the lighting of dark spots and shadows around buildings and homes and lighting walkways, steps, and obstacles. Automatic and timed operation of lighting provides an "at-home" appearance for increased security.

Outdoor lighting also provides important aesthetic benefits. These include making visible the beauty and charm of a home after dark. Features of a home's exterior may be highlighted and landscape areas may be accented. For example, walkways and doors can be illuminated as well as Various lighting techniques are used for placement of a lamp fixture for lighting of buildings and garden areas, including downlighting, uplighting, and backlighting. These terms describe the relationship between the lamp fixture and the objects to be illuminated. For example, downlighting places the lamp fixture above the objects to be illuminated. Further, various styles of lamp fixtures are available, including fixtures with lamps having wide beams of light, narrow accent lights, flood lights for broad general illumination of areas, and spot lights for focusing attention to a feature for highlighting.

One popular mechanism for outdoor lighting systems involves the use of low-voltage lighting having a transformer that supplies electric current at about 12 volts direct current. Low voltage lighting systems are generally safer than high voltage systems, such as one using 120 volts AC. Wiring for low voltage systems can be placed on the ground, preferably buried at shallow depths, or looped through shrubbery and trees. In contrast, high voltage systems require closed conduits, and often require technical expertise to design and install.

Low voltage systems conventionally have a transformer that changes the 120 volt power to 12 volts. The transformer is typically housed in a weatherproof case and connects to an outdoor electrical socket. A cable having a pair of electrical wires attaches to the transformer. The cable is then laid on the ground along the areas to be illuminated, such as a walkway, stairs, garden areas, or side of a home. Lighting fixtures are then positioned at selected locations along the cable. Typically the lighting fixtures mount to stakes which are embedded in the ground. The lighting fixtures are then connected to the cable for electrical communication with the transformer. The cable is then preferably buried shallowly in the ground, but typically no additional conduit is necessary as would be required for 120 volt systems. If desired, a lighting fixture in a low-voltage lighting system may be disconnected from the cable, repositioned, and reconnected. While the original pierced holes in the cable may be wrapped with a tape, it is not necessary to do so.

Various connectors are used to attach wires from the lighting fixtures to the cable. One known connector uses a pair of clips that matingly engage each other while wrapping around the cable. The-clips each include a pointed barb that connects with one of the wires from the lighting fixture. The barbs pierce the cable as the clips are pushed together into engagement. Joining the clips pushes the barbs into electrical communication with the wires in the cable. Another type of connector has a channel defined by flanges, and pointed barbs extend from a surface of the channel between the flanges. The flanges define a recess that slidingly receives a pressure plate which bears forcibly against the cable in the channel for piercing by the barbs to establish electrical communication.

While successful for connecting lighting fixtures to the electrical cable, these connectors have drawbacks that limit their usefulness. Often, some of the lighting fixtures are re-positioned until the installer is satisfied with the illumination. Relocation of lighting fixtures requires removal and reinstallation of the connectors. The clip connector is however not readily separable for relocation. Also, the slideable connector is awkward to use and requires effort and force to slide the pressure plate laterally in the recess in order to exert pressure against the cable. Such connector may be difficult for persons not dexterous with small articles.

Therefore, there remains a need in the art for an improved connector for establishing electrical communication between low-voltage lamps and electrical cables connected with a source of low voltage electricity.

SUMMARY OF THE INVENTION

The present invention solves the need in the art by providing an improved connector for establishing electrical communication between low-voltage lamps and electrical cables connected with a source of low voltage electricity. The connector comprises a base with two opposed spaced-apart sections extending therefrom. The sections define a channel having a longitudinal axis. A distal end of each section has a threaded radially outward surface for receiving a threaded cap. A pair of spaced-apart nails extend from channel with one of the nails on each respective side of the longitudinal axis. Means are provided for connecting the nails to wires that connect for electrical communication with a low-voltage lamp. The cap has a threaded interior surface for engaging the two threaded sections, and a presser pivotally mounts to an interior bottom surface of the cap. The presser is sized for being received in the channel between the two sections for bearing against an electrical cable in the channel as the cap is screwed onto the base. The electrical cable, being received longitudinally in the channel, is piercingly engaged for electrical communication with the nails by the cap being threadingly screwed onto the two sections.

A preferred system of the connector includes a positioner selectively insertable over the cable to accommodate narrow gauge cables. The positioner has a substantially U-shape in cross-sectional view and is sized for being received within the channel over the electrical cable therein. The positioner allows the connector to be used with narrow gauge cable having a thickness insufficient for being contacted and forced by presser of the cap onto the nails while threading the cap onto the two sections. The positioner, being forced against the cable by the rotation of the cap, causes the cable to piercingly engage the nails for electrical communication therewith.

In a preferred embodiment, the connector includes a pair of passages in the base that extend from the nails to a side wall. A pair of wires from the low-voltage lamp insert through the passages into contact with the nails for electrical communication therewith. The base of each nail has a threaded axial bore and a slotted opening. The bore is open to a surface of the base for receiving a screw. The wires, being inserted through the passages and the slotted openings into the axial bores, are secured therein by a screw being threadingly engaged in the axial bore.

The present invention further provides a method of connecting low-voltage lamps in a lighting system to electrical cables extending from sources of low-voltage electricity for electrical communication therewith. The method first places a selected portion of the electrical cable in a channel defined between two opposed sections extending in a first direction from a base. A cap then screws onto threaded radially outward surfaces at distal ends of each section. A presser rotatably mounted to a interior bottom surface of the cap, bears downward, forcing the cable into piercing engagement for electrical communication with a pair of nails projecting from the channel. A pair of wires from a low-voltage lamp are then connected to the nails for electrical communication between the lamp and the source of electricity.

In a preferred method, a positioner is selectively inserted within the channel and over the cable therein depending on the thickness of the cable, for accommodating narrow gauge cables. The positioner is selectively used to fill a gap between the narrow gauge cable and the cap because the cable may be insufficiently thick for the cap to press the cable onto the nails. The positioner accordingly facilitates piercing contact between the cable and the nails.

Objects, features and advantages of the present invention will become apparent upon reading the following detailed description of the disclosed embodiment of the present invention, in conjunction with the appended drawings and claims.

DETAILED DESCRIPTION OF THE PREFERRED EMBODIMENT

Figure 1:
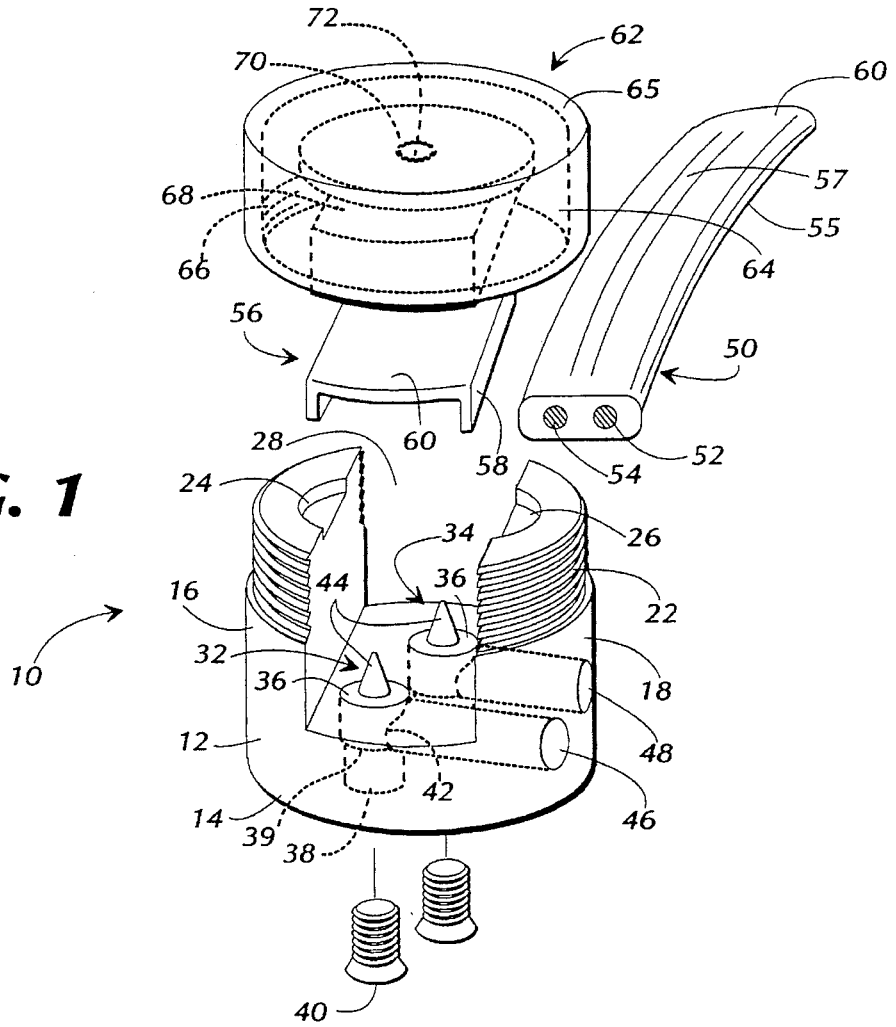
FIG. 1 is an exploded perspective view of a connector in accordance with a preferred embodiment of the present invention.

Referring now in more detail to the drawings in which the same parts have like identifiers, FIG. 1 is an exploded perspective view of a connector 10 in accordance with a preferred embodiment of the present invention. The connector has a base 12 with a lower portion 14. Two oppositely aligned spaced-apart sections 16 and 18 of a cylinder extend in a first direction from the lower portion 14 with distal end portions 20 and 22 defining threaded radially outer surfaces for receiving a threaded cap 62, as discussed below. A distal end of each of the sections 16 and 18 includes a recessed portion 24 and 26, respectively. The sections 14 and 16 define a channel 28 having a longitudinal axis in the connector 10. An exterior surface of the base 12 preferably defines a series of grooves and ridges for a texture for grippingly holding the connector 10 during use to connect a lamp fixture to a cable, as discussed below.

A pair of electrical contacters 32 and 34 are received in the lower portion 14 of the connector on respective sides of the longitudinal axis of the channel 28. The electrical contacters 32 and 34 in the illustrated embodiment each comprise a base 36 having a threaded axial bore 38 and a slot-like opening 42 in the base 36. The bore 38 is open to a bottom surface 39 in the base 36 for receiving a screw 40 into the bore. A sharp piercing nail 44 extends upwardly from the base 36 above a surface of the channel 28. A pair of passages 46 and 48 extend inwardly from a sidewall of the lower portion 14 and communicate with the slot-like opening 42 in the respective electrical contacter 32 and 34. The electrical contacters 32 and 34 are made of an electrically conductive material.

FIG. 1 further illustrates an electrical cable 50 exploded from the base 12 of the connector 10. The cable 50 includes a pair of wires 52 and 54, which preferably comprise a plurality of narrow gauge wire threads grouped together to form a predetermined wire gauge for the cable 50. The wires 52 and 54 are conventionally encased in a plastic jacket 55 and separated by a groove 57 extending longitudinally along the cable 50.

A positioner 56 is illustrated exploded from the cable 50. The positioner 56 is an elongated member having a wide U-shape in cross section defined by a pair of sides 58 that extend in a first direction from a back 60. The positioner 56 is sized for receiving the cable 50 between the side 58 and the back 60 in the channel 28, as discussed below.

FIG. 1 also illustrates a cap 62 shown exploded from the base 12 of the connector 10. The cap 62 includes a skirt 64 that extends in a first direction around the perimeter of a top 65. An interior surface of the skirt 64 includes a thread 66 for matingly engaging the cap 62 with the threaded upper distal portions 20 and 22 of the sections 16 and 20. A presser 68 includes an integral disk 69 and rotatably mounts at a pivot 70 in the cap 62 by a screw 72, for a purpose discussed below. In an alternate embodiment, the presser 68 does not include the disk 69. The base 10, the positioner 56, the cap 62, and the presser 68 are preferably made of a rigid plastic material in a molding process.

Figure 2:
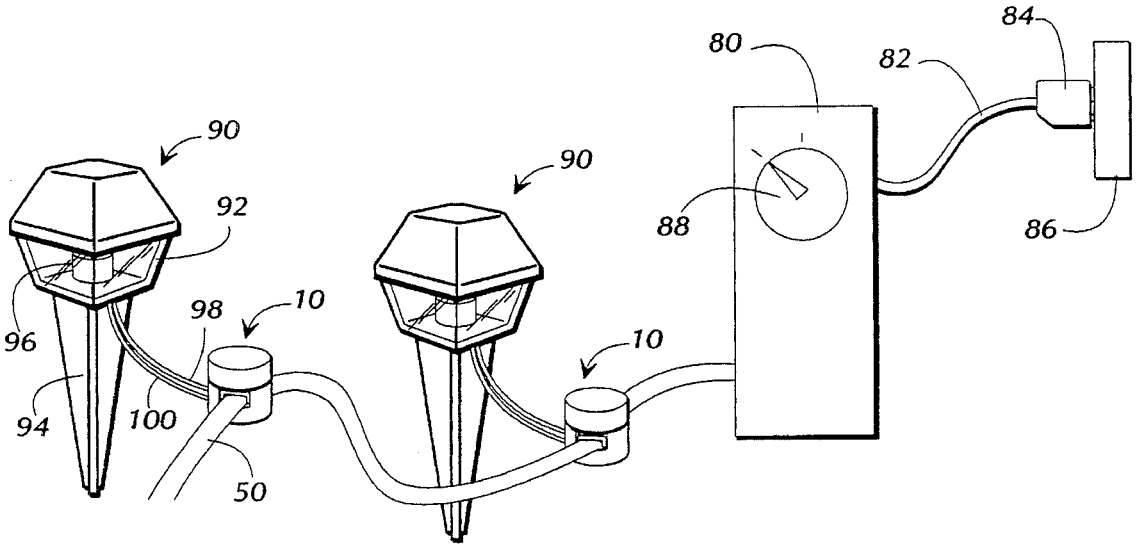
FIG. 2 is a perspective view of a low-voltage lamp connected selectively with the connector illustrated in FIG. 1 to an electrical cable extending from a source of low-voltage electricity.

FIG. 2 illustrates a perspective view of a low-voltage lamp fixture 90 connected selectively with the connector 10 to the electrical cable 50 extending from a transformer 80 that provides a supply of low-voltage electricity. The transformer 80 includes an electrical cord 82 having a plug 84 for connecting to a supply of electricity, such as a junction box 86 attached to a house. Transformers for low-voltage lighting fixture systems typically include a timer 88 for setting the on- and off-times for supplying electrical current to the lamp fixture 90.

The lamp fixture 90 includes a light-transmissive housing 92 and is typically fixed in the ground by a stake 94. A lamp 96 is held in a socket in the lamp fixture 90 and connects to a pair of wires 98 and 100 that extend outwardly of the housing 90 for connection with the cable 50 by the connector 10.

After the transformer 80 is attached to a support, such as a side of a house, the plug 84 is connected to the junction box 86 for supplying electrical current to the transformer. The cable 50 attaches in a conventional manner to the transformer and is then laid along the ground or in a shallow trench in the ground along the areas to be illuminated by one or more of the lamp fixtures 90. Typically, the cable parallels a sidewalk, garden path, or side of a house, to be illumined. The lamp fixtures 90 are positioned by embedding the stake 94 in the ground.

The lamp fixtures 90 are then connected to the cable 50. The bare ends of the wires 98 and 100 uncovered of insulation are selectively inserted into a respective one of the passages 34 and 36 in one of the connectors 10. In an alternate embodiment (not illustrated), the ends of the wires 98 and 100 are stripped of insulation for electrical communication and a metallic cap is attached to the stripped wire end. The ends of the wires 98 and 100 extend through the respective slot openings 42 in the bases 36. The screws 40 then threadingly engage the bores 38 and press against the wire ends in the respective bases 36 for securing the wires in electrical communication with the nails 44. In another alternate embodiment, the wires 98 and 100 are rigidly fixed, such as by solder or mechanical connection such as crimping, to electrically conductive barbs, such as the nails 44, extending from the base 12. The base of the connector 10 is thereby pre-joined with the lamp fixture 90, instead of securing the base 12 to the wires 98 and 100 when installing the lighting system. In this embodiment, the electrical contacters 32 and 34 do not have the threaded axial bore 38 for the screw 40.

The cable 50 is then positioned in the channel 28. The cap 62 threadingly engages the threaded upper ends 20 and 22 of the sections 14 and 16 on the base 12. The sides of the presser 68 align with the channel 28 for slidingly moving therethrough from the open distal end of the channel 28 toward the nails 44 as the cap 62 threads onto the sections 16 and 18 of the base 12. The cap 62 rotates with respect to the presser 68 by the pivotably mounted disk 69 which is received in the recesses 24 and 26 as the cap is threaded onto the base 12. The presser 68 bears against an upper surface of the cable 50. As the cap 62 threads onto the base 12, the presser 68 forces the cable 50 against the nails 44 which pierce the insulation covering the wires 52 and 54, respectively, to provide electrical communication from the cable through the electrical contacter and wires 98 and 100 to the lamp 96. For convenience, the connector 10 may be first attached to the cable 50 and then the wires 98 and 100 from the lamp are attached to the connector. While the present invention has been disclosed with a preferred embodiment and method for use with low-voltage lighting systems, such would be advantageously used in higher voltage systems as well.

Cables of electrical wire typically are provided in one of several standard sizes for use in low-voltage lighting systems having transformers and lamp fixtures. The cables are sized in terms of gauge, and typically are 12, 14 or 16 gauge, which refers to the cross-sectional diameter of the electrical wires carded in the cable. Conventionally, the lower number refers to a wire capable of carrying a higher amount of electrical current. The cables of lower gauge wires typically have more insulation than those of higher gauge wires, and thus, are thicker in cross-section. The present invention provides the positioner 50 for accommodating cables made of higher gauge wires having insufficient thickness for being pushed by the presser 68 into piercing contact with the nails 44. In a system of the connector 10 according to the present invention, two positioners 56 are provided. The back 60 of a first positioner 56 is thicker than that of a second positioner. The first positioner 56 is preferably used with the higher gauge cable (i.e., the thinner cable) while the second positioner is preferably used with a cable of an intermediate gauge. The positioner 56 is selectively inserted within the channel 28 and over the cable 50 therein depending on the thickness of the cable, for accommodating narrow gauge cables. The positioner 56 is selectively used to fill a gap between the narrow gauge cable 50 and the cap 62 because the narrow gauge cable may be insufficiently thick for the cap to press the cable onto the nails 44. The positioner 56 accordingly facilitates piercing contact between the cable 56 and the nails 44. In a preferred embodiment, the connector 10 is sized for receiving cable 50 of a gauge that does not require use of one of the positioners 56. The presser 68 in the cap bears against the cable 50 sufficiently to pierce the cable by the nails 44 in order to establish electrical communication with the transformer 80 as the cap 62 is threadingly engaged to the base 12. The present invention thereby provides a connector and method for electrical communication in a lighting system between a low-voltage lamp positioned selectively to an electrical cable connected with a source of low-voltage electricity.

The principles, preferred embodiments and modes of operation of the present invention have been described in the foregoing specification. The invention is not to be construed as limited to the particular forms disclosed because these are regarded as illustrative, rather than restrictive. Moreover, variations and changes may be made by those skilled in the art without departing from the spirit of the invention as described by the following claims.

What is claimed is:

1. A connector for electrical communication between a low-voltage lamp and an electrical cable connected with a source of low-voltage electricity, comprising:

a base with two opposed sections extending in a first direction therefrom and defining a channel having a longitudinal axis therebetween, a distal end of each section having a threaded radially outward surface for receiving a threaded cap;

a pair of spaced-apart nails held in the base and extending from the channel with one of the nails on respective sides of the longitudinal axis, each nail defining a threaded axial bore open to a surface of the base for receiving a screw and a slotted opening in a side of the nail for receiving a wire from a low-voltage lamp, the wire secured in electrical communication with the nail by the screw;

a cap having a threaded interior surface for engaging the two threaded sections; and a presser pivotally mounted to an interior bottom surface of the cap, the presser sized for being received between the two sections for bearing against the electrical cable in the channel, whereby an electrical cable, being received longitudinally in the channel, is piercingly engaged for electrical communication with the nails by the cap being threadingly screwed onto the two sections.

2. The connector as recited in claim 1, further comprising a positioner having a substantially U-shape in cross-sectional view and sized for being received within the channel over the electrical cable therein for accommodating cable of an insufficient thickness for being contacted by the presser as the cap is threaded onto the two sections, whereby the positioner being forced against the cable, causes the cable to piercingly engage the nails for electrical communication therewith.

3. The connector as recited in claim 1 further comprising a pair of passages in the base extending from the nails to a side wall, whereby the wires from the low-voltage lamp insert through the passages into contact with the nails for electrical communication therewith.

4. The connector as recited in claim 1, wherein the presser further includes a circular disk; and the distal ends of the opposed sections include radially inner recesses for receiving portions of the disk while the presser, being aligned with the channel, applies force against the cable for pushing same into piercing contact with the nails.

5. A connector system for establishing in a lighting system electrical communication between an electrical cable extending from a source of low-voltage electricity and a low-voltage lamp positioned at a selected place on the electrical cable, comprising:

a base with two opposed sections extending in a first direction therefrom and defining a channel having a longitudinal axis therebetween, a distal end of each section having a threaded radially outward surface for receiving a threaded cap, and the distal end defining a radially inner recess;

a pair of spaced-apart nails extending from the channel, one of the nails on each respective opposing side of the longitudinal axis;

means for connecting each of the nails to a respective wire for electrical communication with a low-voltage lamp;

a cap having a threaded interior surface for engaging the two threaded sections;

a presser pivotally mounted to an interior bottom surface of the cap, the presser sized for being received between the two sections in the channel and including a circular disk between the cap and the presser;

at least one positioner for being selectively received within the channel over an electrical cable therein, for accommodating cable of an insufficient thickness, whereby the positioner, being forced against the cable by the presser, causes the cable to piercingly engage the nails for electrical communication therewith, whereby the cap, being threadingly screwed onto the two sections moves the presser and positioner against the electrical cable aligned in the channel to push same into piercing contact with the nails for electrical communication while the recesses receive portions of the circular disk.

6. The connector system as recited in claim 5, further comprising a pair of passages in the base extending from the nails to a side wall, whereby the wires from the low-voltage lamp insert through the passages into contact with the nails for electrical communication therewith.

* * * * *